United States Patent [19]

Canfield

[11] Patent Number: 4,801,328

[45] Date of Patent: Jan. 31, 1989

[54] DEOXIDIZING AGENT

[76] Inventor: Glenn Canfield, 303 Ramblewood Pl., Longview, Tex. 75601-3055

[21] Appl. No.: 140,125

[22] Filed: Dec. 31, 1987

[51] Int. Cl.[4] ..... C21C 7/02

[52] U.S. Cl. ..... 75/58; 75/53

[58] Field of Search ..... 75/53, 58, 93 G; 420/129; 428/570, 653, 576

[56] References Cited

U.S. PATENT DOCUMENTS 2,397,418 3/1946 Howard ..... 75/93 G 3,915,693 10/1975 Rasmussen ..... 75/93 G

*Primary Examiner*—Peter D. Rosenberg

*Attorney, Agent, or Firm*—Ronald B. Sefrna

[57] ABSTRACT

The present invention discloses an agent for the deoxidation of ferrous melts, generally comprising a discrete layer of aluminum surrounding a ferrous core, and a method of deoxidation of ferrous melts utilizing the agent of the invention to provide an improved aluminum deoxidation efficiency. The agent of the invention is also useful as an alloying agent for the addition of aluminum to a ferrous melt for the purpose of producing a ferrous-aluminum alloy.

16 Claims, 1 Drawing Sheet

DEOXIDIZING AGENT

FIELD OF THE INVENTION

The present invention generally relates to deoxidizing agents and methods of deoxidizing a molten ferrous metal, and more specifically relates to an aluminum based deoxidizing agent and a method of deoxidizing a ferrous melt as a step in the commercial production of steel.

BACKGROUND OF THE INVENTION

One of the most importan metallurgical operations for the production of steel is controlled deoxidation in the melt, since the presence of excessive free oxygen will result in porosity of the finished steel. Although a large number of different deoxidizing agents may be used in the process of steelmaking, aluminum has become the most widely used deoxidizer in the production of cast steels, and addition of aluminum at some stage of the steelmaking process is almost universal.

Very effective deoxidation may be achieved with only small additions of aluminum to the melt, but it is well understood in the steelmaking industry that control of the amount of aluminum introduced into the melt in relation to the amount of molten steel is important in controlling the presence of insoluble inclusions in the finished steel. Small additions of aluminum may result in the formation of inclusions resulting in poor steel ductility, whereas excessive additions of aluminum may result in the presence of aluminum nitride precipitates which increase the brittleness of the finished steel.

In addition, although only relatively small amounts of aluminum are required for effective deoxidation of the melt, increasing costs of metallic aluminum have caused steelmakers to become more concerned with the cost of aluminum addition during the steelmaking process. This consideration has lead to more careful control of the total amount of aluminum added to the melt, and steelmakers have become increasingly concerned with the efficiency of the aluminum or aluminum based deoxidizing agent used.

Traditionally, essentially pure metallic aluminum has been the most common form of aluminum deoxidizing agent used in the steelmaking process, in any convenient form such as notch bars, small ingots, shot, and chopped wire. The use of essentially pure aluminum presents some significant disadvantages, however, arising primarily from its low density as compared to the molten steel to which the aluminum is added. The density of liquid aluminum at steelmaking temperatures of approximately 1600 degrees C is only about 2 grams per cubic centimeter, whereas the density of molten steel at the same temperature is greater than 7 grams per cubic centimeter. Therefore, when aluminum is added to the melt, it will float at the steel/slag interface, where the aluminum rapidly oxidizes, with relatively small amounts of the aluminum actually making contact with the molten steel. The efficiency of the aluminum as a deoxidizing agent is thus limited by the rate at which oxygen in the melt can diffuse upward to the slag/steel interface, and deoxidation performance is erratic.

In an effort to overcome this disadvantage of the use of essentially pure metallic aluminum, steelmakers have sought other forms of aluminum deoxidizing agents. One such agent is an iron/aluminum alloy mixture with aluminum, known in the industry as ferroaluminum. The composition of ferroaluminum is nominally thirty-five to forty percent aluminum and sixty-five to sixty percent iron or steel. The solubility of aluminum is about twelve percent, so the ferroaluminum agent consists of a combination of aluminum/iron alloy to the solubility concentration, with the remainder of the aluminum existing as pockets of essentially pure aluminum agglomerated with the alloy material. The density of ferroaluminum is about twice the density of pure aluminum, resulting in deeper penetration of the ferroaluminum oxidizing agent into the molten steel. Because of the deeper penetration, resulting in improved contact between the deoxidizing agent and the molten steel, ferroaluminum does produce an improved deoxidation efficiency in comparison to aluminum alone, but still suffers from certain disadvantages.

It has been found that adhesion between the aluminum/iron alloy and the pockets of metallic aluminum present in the ferroaluminum agent is poor, and the ferroaluminum product displays a pronounced tendency to decrepitate, with crumbling and separation, during storage and handling prior to its addition to the melt. It has also been found that ferroaluminum displays the same tendency to separate into discrete pieces of metallic aluminum and aluminum/iron alloy as a result of thermal shock upon its introduction into molten steel, even if its physical integrity has been maintained prior to that introduction. With such separation, much of the theoretical efficiency of the ferroaluminum agent is lost in practical use of the agent, though its deoxidation efficiency is still higher than that of essentially pure aluminum alone. Further, iron is an ineffective deoxidizing agent, and the physical mixture of iron with aluminum in the alloyed portion of the ferroaluminum agent dilutes the total amount of aluminum available for reaction per unit of surface area as compared to pure aluminum, resulting in lower relative reactivity. Thus the ferroaluminum deoxidizing agent represents a compromise between density and reactivity.

There remains a need, therefore, for an aluminum deoxidizing agent which provides an apparent density greater than that of pure aluminum, for improved penetration into the melt, without a sacrifice of reactivity of the agent as compared to pure aluminum.

SUMMARY OF THE INVENTION

It is an object of the present invention to provide an economical aluminum based agent for the deoxidation of molten steel which provides consistent deoxidation results at high efficiency levels. It is a further object of the present invention to provide such a deoxidizing agent which displays good physical integrity for ease of storage and use, and which is readily adaptable to varying requirements for the proportion of aluminum present in the deoxidizing agent.

The deoxidizing agent of the present invention is a composition of matter consisting essentially, in its preferred embodiment, of a ferrous metal core surrounded by a discrete layer of metallic aluminum. In the preferred embodiment, the deoxidizing agent is produced with nominal aluminum proportions in the range of thirty percent by weight to fifty percent by weight, but the agent may be readily provided in almost any convenient proportion. The specific proportional composition of the deoxidizing agent of the invention may thus be tailored to any particular process or operator requirements. The deoxidizing agent of the invention may also be provided in almost any size and shape for ease of transportation, storage, and use, and displays no tendency to separate during handling or upon introduction into the molten steel.

The deoxidizing agent of the invention is prepared by physically molding a discrete layer of nominally pure aluminum around a core of suitable size and shape. The deoxidizing agent of the invention may be readily produced in billets of essentially any configuration and size desired by the user.

In use for deoxidation of molten steel, the deoxidization agent of the invention, prepared in the required proportions, size and configuration, is introduced into the melt at the point in the steelmaking process selected by the operator. With an apparent deoxidizing agent density essentially equivalent to that of ferroaluminum, penetration of the agent into the melt is good, and with an exterior surface consisting essentially of pure metallic aluminum, reactivity of the agent is high, resulting in a high deoxidation efficiency.

The agent of the invention has also been found to be useful as an alloying agent, for the purpose of adding aluminum to a ferrous melt to form an aluminum containing ferrous alloy. Because the agent of the invention achieves a deeper penetration into the melt than does nominally pure metallic aluminum, homogenous distribution of the alloying aluminum through the melt is more readily and rapidly accomplished with decreased stirring or agitation of the melt, resulting in higher efficiency and lowered cost of aluminum addition.

The composition of matter and method of the invention will now be described in more detail with reference to the accompanying figures.

DETAILED DESCRIPTION OF THE INVENTION

Figure 1:
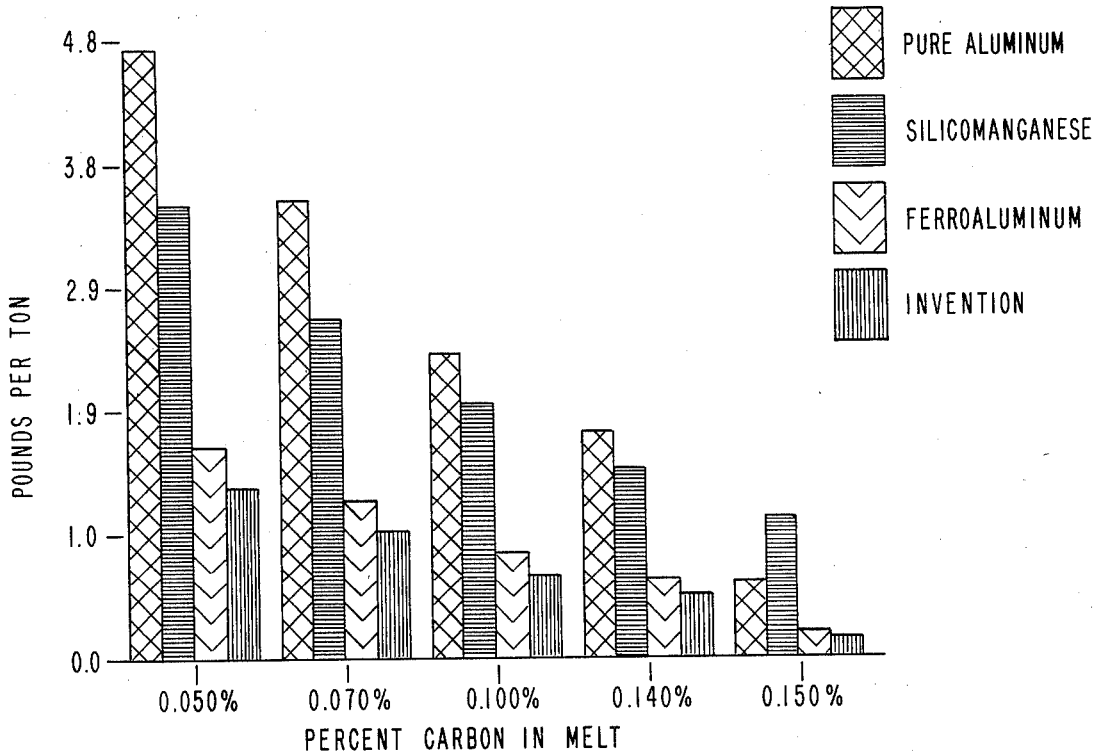
FIG. 1 is a graphical comparison of the deoxidizing efficiency of the deoxidizing agent of the invention to the deoxidizing efficiency of various other deoxidizing agents, in terms of pounds of agent per ton of steel as a function of percentage of carbon present in the molten steel.

The deoxidizing agent of the invention is a composition of matter adapted for the efficient deoxidation of molten steel and other molten ferrous metals, generally comprising a core of material which is chemically and physically compatible with the specifications of the metal with which the deoxidizing agent is to be used, substantially surrounded by a discrete layer of metallic aluminum. The core material should have a density greater than the density of the surrounding aluminum.

As discussed above, metallic aluminum is a very effective agent for the deoxidation of molten ferrous metals, but suffers the disadvantage of low density relative to the molten metal with which it is used. It has been found that the deoxidation efficiency of metallic aluminum is substantially increased if the penetration of the metallic aluminum into the molten metal is increased. It has further been found that such penetration can be increased without reduction in the chemical activity of the metallic aluminum by layering metallic aluminum around a core material of significantly higher density to produce a deoxidizing billet with the same surface activity as aluminum alone but with an apparent density significantly above that of aluminum alone.

In the preferred embodiment of the deoxidizing agent of the invention, the core material used is a ferrous metal consisting essentially of iron, which will be readily compatible with the molten ferrous metal to be deoxidized. The proportional relationship between the amount of aluminum and the amount of ferrous metal core comprising each billet of deoxidizing agent is preferably maintained within the range of about thirty percent aluminum by weight to about fifty percent aluminum by weight. With a typical metallic aluminum density of 2.8 grams per cubic centimeter and a typical ferrous metal core material density of 7.8 grams per cubic centimeter, the apparent density of the deoxidizing agent of the invention at various proportions within the preferred range is illustrated by the following table:

| % Al by weight | apparent density (gm/cc) |
|---|---|
| 30 | 6.3 |
| 35 | 6.0 |
| 40 | 5.8 |
| 45 | 5.6 |
| 50 | 5.3 |

At the upper limit of the preferred range of aluminum proportion, the apparent density of the deoxidizing agent of the invention is almost twice the density of metallic aluminum alone, and at the lower limit of the preferred range the apparent density begins to approach that of the molten steel.

The purity of the metallic aluminum component of the deoxidizing agent of the invention should preferably be maintained at ninety-five percent or above pure aluminum, which is typical of the purity of aluminum used in other forms as a deoxidizing agent in the refining of molten steel. However, aluminum of lesser purity may be used if acceptable for a particular deoxidizing application. In the preferred embodiment of the deoxidizing agent of the invention the core material should be not less than about ninety-five percent iron, to insure compatibility of the core with the molten ferrous metal to be deoxidized. The core material is not limited to iron or steel, however, and any material having a suitable high density which is compatible with the molten ferrous metal and the metallurgical process may be employed.

Figure 2:
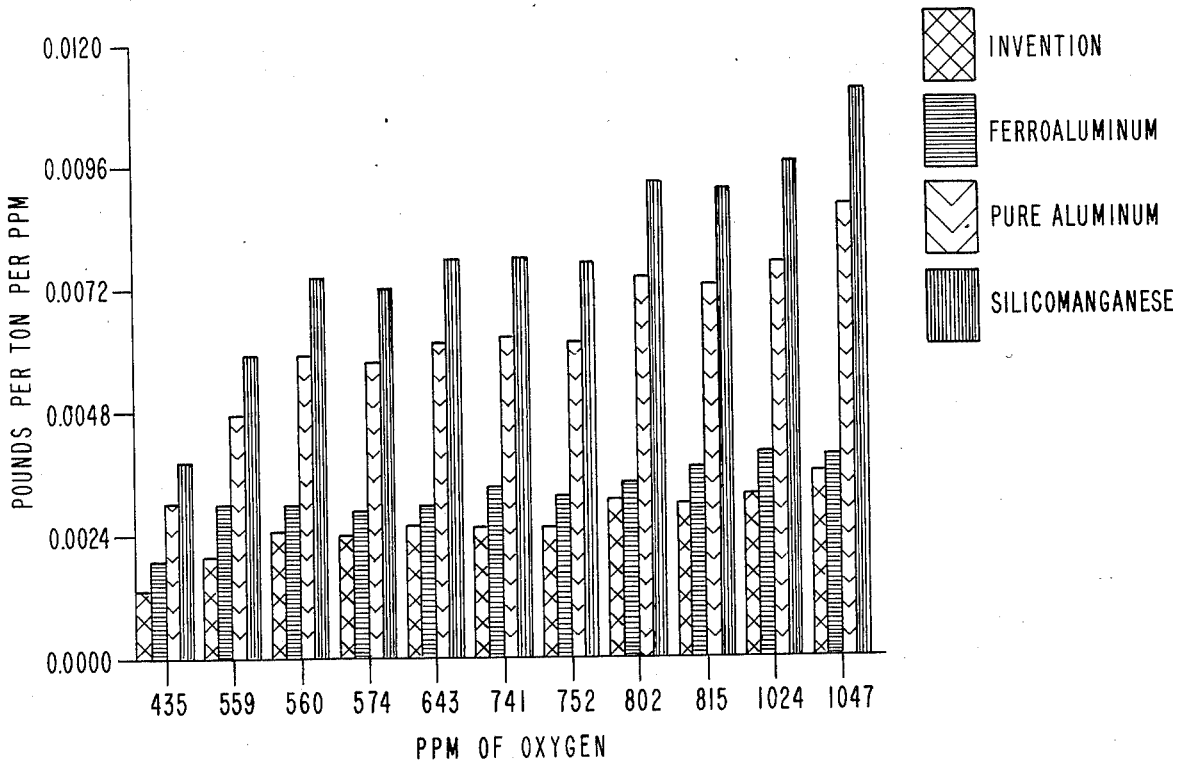
FIG. 2 is a graphical comparison of the deoxidizing efficiency of the deoxidizing agent of the invention to the deoxidizing efficiency of various other deoxidizing agents, in terms of pounds of agent per tonof steel per part per million of oxygen present in the steel as a function of the concentration of oxygen present in the steel in parts per million.

It has been found that the deoxidizing agent of the invention provides consistently improved deoxidation efficiency in comparison to other forms of aluminum-based deoxidizing agents, as illustrated by the accompanying graphical figures. Both FIG. 1 and FIG. 2 represent a comparison of the efficiency of the deoxidizing agent of the invention at a nominal forty percent aluminum proportion, to nominally pure metallic aluminum and to ferroaluminum, a heterogenous comglomeration of iron and aluminum, in terms of pounds of deoxidizing agent required for essentially complete deoxidation in a given melt of ferrous metal. To illustrate the efficiency of the deoxidizing agent of the invention to non-aluminum based agents, silicomanganese, a commonly used non-aluminum based deoxidizing agent, is included in the comparison results presented in FIGURE 1 and FIG. 2.

In FIG. 1, the comparison basis is total pounds of deoxidizing agent added per ton of ferrous metal melt as a function of the percentage of carbon present in the melt, which bears an inverse relation to the amount of oxygen present. In every test condition, the deoxidizing agent of the invention displayed a higher efficiency than the comparison agents, as apparent from its lower useage requirement.

In FIG. 2, the comparison basis is total pounds of deoxidizing agent per ton of ferrous metal melt per part per million of oxygen present in the melt, as a function of the oxygen concentration of the melt in parts per million of oxygen. AT every oxygen level tested the deoxidizing agent of the invention was more efficient than the comparison agents. The improvement in efficiency offered by the agent of the invention was more pronounced at lower oxygen concentrations, illustrating the combined advantages of deeper penetration of the agent into the melt as compared to aluminum alone, and of the higher chemical activity at the surface of the agent of the invention, as compared to ferroaluminum, afforded by the presentation of nominally pure aluminum to the melt. However, the improvement in efficiency was manifested at higher oxygen concentrations as well, which serves to demonstrate the broad range of usefulness of the deoxidizing agent of the invention.

The deoxidizing agent of the invention is preferably produced by a process of molding a layer of nominally pure aluminum onto a suitable core. In its preferred embodiment, the production process comprises the steps of 1. preparing the core of the appropriate weight and configuration, 2. cleaning and drying the core, 3. placing the core in a mold selected to provide the desired final configuration, 4. pouring molten aluminum of the selected chemical composition over and around the selected core in an amount selected to provide the desired final proportion by weight, 5. allowing sufficient cooling time for the aluminumlayer to stabilize, and 6. removing the completed agent from the mold for storage or use. However, it will be understood that, since the aluminum component of the deoxidizing agent of the invention is formed in a discrete layer, any process of manufacture which results in a secure physical interconnection between the aluminum layer and the core may be employed.

In the process of using the deoxidizing agent of the invention for the deoxidation of molten ferrous metal, the user will first determine the amount of oxygen to be removed from the melt, then select the embodiment of the deoxidizing agent of the invention to be used by choosing the core material, configuration, and proportional composition by weight, then determine the total quantity of the deoxidizing agent of the invention to be added to the melt, and finally introduce the deoxidation agent of the invention to the molten ferrous metal, whereupon the deoxidizing agent of the invention will achieve a combination of improved penetration into the molten ferrous metal and improved chemical deoxidation activity at the surface of the deoxidizing agent as compared to previously known aluminum-based deoxidizing agents.

It has also been found that the agent of the invention is useful as an alloying agent for the addition of aluminum to molten ferrous metals in the process of producing an aluminum containing steel alloy. Although the use of an aluminum based deoxidizing agent results in the presence of some residual quantity of unoxidized aluminum in the melt, it is common practice to adjust the percentage by further addition of aluminum at a later stage in the process for producing alloyed steels. Because of the deeper penetration of the agent of the invention into the melt and improved contact between the molten ferrous metal with the aluminum component of the agent of the invention, use of the agent of the invention as an alloying agent results in more efficient distribution of the aluminum through the melt and allows the preparation of a homogenous alloy in a shorter time with reduced agitation requirements as compared to the use of aluminum alone.

The foregoing detailed description of the invention has been for purposes of illustration and not for limitation. Although a number of embodiments of the invention have been disclosed, the deoxidizing agent of the invention and the improvement in the process of deoxidizing molten ferrous metals are susceptible to various other modifications and alternative embodiments without departing from the scope and spirit of the invention as claimed.

I claim:

1. A deoxidizing agent for molten ferrous metals comprising:
   - a core of material being chemically non-reactive with the ferrous metal to be deoxidized and having a density greater than the density of metallic aluminum; and
   - one or more discrete layers of metallic aluminum substantially surrounding said core.

2. The deoxidizing agent of claim 1, wherein the material of said core has a density greater than or equal to the density of iron.

3. The deoxidizing agent of claim 1, wherein the material of said core is a ferrous metal.

4. The deoxidizing agent of claim 1, wherein said metallic aluminum of said one or more discrete layers of metallic aluminum consists of not less than about ninety-five percent pure aluminum.

5. The deoxidizing agent of claim 1, wherein the material of said core is a ferrous metal and the proportion of metallic aluminum comprising said deoxidizing agent is between about thirty percent by weight and about fifty percent by weight.

6. A deoxidizing agent for molten ferrous metals comprising:
   - a core of material consisting essentially of iron and being chemically non-reactive with the molten ferrous metal to be deoxidized; and
   - a discrete layer of metallic aluminum disposed at least partially around the outer surface of said core and interconnected thereto so as to maintain the interconnection between said layer of metallic aluminum and said core upon immersion of the deoxidizing agent in molten ferrous metal.

7. The deoxidizing agent of claim 6, wherein said layer of metallic aluminum consists of not less than about ninety percent pure aluminum.

8. The deoxidizing agent of claim 6, wherein said layer of metallic aluminum consists of not less than about ninety-five percent pure aluminum.

9. The deoxidizing agent of claim 6, wherein said core consists of not less than about ninety percent iron.

10. The deoxidizing agent of claim 6, wherein said core consists of not less than about ninety-five percent iron.

11. The deoxidizing agent of claim 6, wherein the proportion of aluminum comprising said deoxidizing agent is between about ten percent by weight and about seventy-five percent by weight.

12. The deoxidizing agent of claim 6, wherein the proportion of aluminum comprising said deoxidizing agent is between about thirty percent by weight and about fifty percent by weight.

13. In a process of producing a deoxidizing agent consisting essentially of iron and aluminum for the deoxidizing of molten ferrous metals, the improvement comprising interconnecting a discrete layer consisting essentially of metallic aluminum on the exterior of a core consisting essentially of iron.

14. An alloying agent for introducing aluminum to molten ferrous metal for the purpose of producing a ferrous metal alloy containing aluminum, comprising:

a core of material being chemically nonreactive with the ferrous metal to which such alloying agent is to be introduced and with the ferrous metal alloy to be produced and having a density greater than the density of aluminum; and a discrete layer of metallic aluminum disposed on the surface of said core and interconnected thereto.

15. The alloying agent of claim 14, wherein said core consists essentially of iron.

16. The alloying agent of claim 14, wherein said metallic aluminum consists of not less than about ninety-five percent pure aluminum.

* * * * *